United States Patent [19]

Thompson

[11] 3,986,300

[45] Oct. 19, 1976

[54] OPERATING MEANS FOR PIVOTED WINDOWS

[75] Inventor: Norman Thompson, Wolverhampton, England

[73] Assignee: Beta Aluminium Products Limited, Bridgnorth, England

[22] Filed: May 27, 1975

[21] Appl. No.: 581,425

[30] Foreign Application Priority Data

May 31, 1974 United Kingdom ..... 24158/74

[52] U.S. Cl. ..... 49/341; 49/83; 74/60

[51] Int. Cl.[2] ..... E05F 11/24

[58] Field of Search ..... 49/82–85, 49/341–343, 371; 74/25, 60

[56] References Cited

UNITED STATES PATENTS

| | | | |
|---|---|---|---|
| 2,774,590 | 12/1956 | Blanchard | 49/83 |
| 2,981,538 | 4/1961 | Bennett | 49/83 |

*Primary Examiner*—Kenneth Downey
*Attorney, Agent, or Firm*—Young & Thompson

[57] ABSTRACT

Operating means for a window including a horizontally pivoted panel comprises an elongated torque tube extending parallel to the panel pivot axis. A torque-transfer element is pivotally connected to the torque tube for movement relative thereto about a primary transverse axis and an operating crank, which is drivingly connected to the torque-transfer element, is arranged for rotation relative to a horizontal axis at right angles to the axis of the torque tube.

10 Claims, 5 Drawing Figures

OPERATING MEANS FOR PIVOTED WINDOWS

Figure 1:
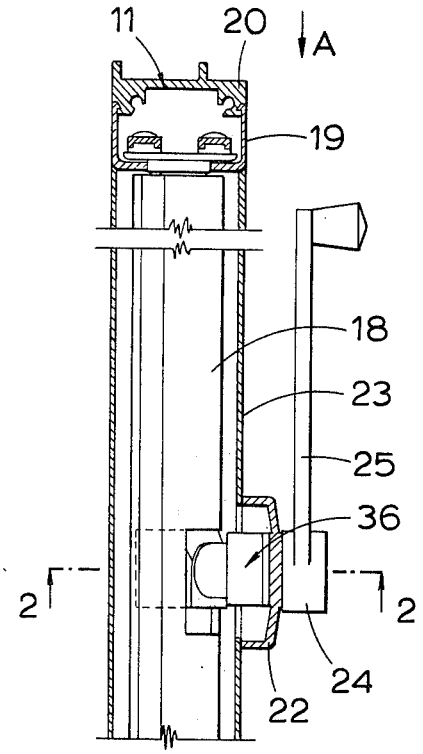

This invention relates to operating means for windows of the type employing one or more horizontally pivoted panels, which extend laterally of the window frame and pivot about horizontal axes between closed, substantially vertical, positions and open, substantially horizontal, positions.

One of the problems with horizontally pivoted window panels is to ensure that a good seal is achieved on both sides of the window and, in the case of multipanel windows, that a good seal is obtained along the horizontal junctions between the panels. This is a particular problem in the case of louvre windows which rely simply on a seal being provided by the bottom edge of one louvre panel overlapping and contacting the louvre immediately below it. Such windows usually employ regulator means which act to move the louvres by means of linkages which are disposed at one side only of the window. As the closing torque is applied by the regulator linkage to one end of each louvre the tendency is for a good seal to be produced at that end and a slight gap to be left at the other end when the window is closed. Another problem is that the operating means should require either no maintenance or a minimum of maintenance and that substantially no wear of the components should take place, since wear will eventually lead to uneven or unreliable sealing.

It is accordingly an object of the invention to provide improved operating means for horizontally pivoted window panels, in particular louvre windows. A more specific object is to provide operating means which affords reliable sealing throughout the window whilst at the same time includes as few components as possible, said components being so designed as to reduce wear and thereby increase reliability and efficiency.

According to the invention there is provided operating means for a window including a horizontally pivoted panel comprising an elongated tube arranged for rotation relative to the window frame about its axis of elongation, a torque-transfer element pivotally connected to the tube for rotation relative thereto about a primary axis extending transversely to said axis of elongation, an operating crank arranged for rotation relative to the window frame about a secondary axis extending transversely to and intersecting said axis of elongation and a drive connection between said torque-transfer element and said crank.

The tube is preferably a hollow torque tube which is arranged for rotation about a horizontal axis extending from side to side of the window. The secondary axis, i.e. the axis about which the crank rotates relative to the window frame, is preferably also horizontal but in this case it extends at right angles to the plane of the window.

The torque-transfer element is conveniently in the form of a pin which is freely rotatable within a bore of a block fitted in a slot in a torque-tube. The block is conveniently formed from an acetal resin which may be impregnated with oil to provide self-lubricating characteristics. The bore in the block extends at right angles to the axis of the torque tube and the block is capable of limited rotational movement to accommodate movement of the pin during rotation of the crank.

The crank is conveniently formed as a moulding from a synthetic plastics material such as a polyacetal resin, for example that sold under the registered trade mark "Delrin", the crank being moulded so that the pin forming the torque-transfer element is integral therewith, and the crank including a generally cylindrical portion which is mounted in a bearing aperture in a cover plate of the window frame and a connecting portion between the generally cylindrical portion and the part surrounding the pin. The generally cylindrical portion is conveniently internally splined for engagement with splined teeth of an operable handle which may be either manually operated or remotely geared.

In use, the components of the operating means are conveniently arranged so that the crank can be turned between a first limiting position in which the primary and secondary axes are contained in a common vertical plane and the louvre window is closed and a second limiting position in which the window is open, the design of the components being such that when the crank is in said first limiting position a load is applied to the torque tube whereby the louvres of the window are moved under a predetermined load into their closed positions.

Opening of the window is preferably facilitated by ensuring that the greatest mechanical advantage as regards movement of the manual handle is obtained when the crank is moved out of its first limiting position, i.e. during initial opening movement of the window. By having a bearing arrangement between the crank and the cover plate which comprises fitment of a generally cylindrical portion of the crank in a sleeve of the cover plate, it is possible to ensure that large bearing surfaces are provided thus reducing wear of the components and maintaining efficient operation. As mentioned above, the crank may be formed as a moulding of a synthetic plastics material and the pin of stainless steel. Alternatively the crank may be formed as a casting with the pin contained within the casting.

The ends of the torque tube may carry drive plates containing two studs corresponding to those associated with the drive plates which drive the louvre panels. The linkages in the side members fit over these studs to provide a conventional symmetrical parallel driving arrangement. The whole of the design is such as to ensure efficient operation with minimum wear and tear and a minimum number of components.

Figure 2:
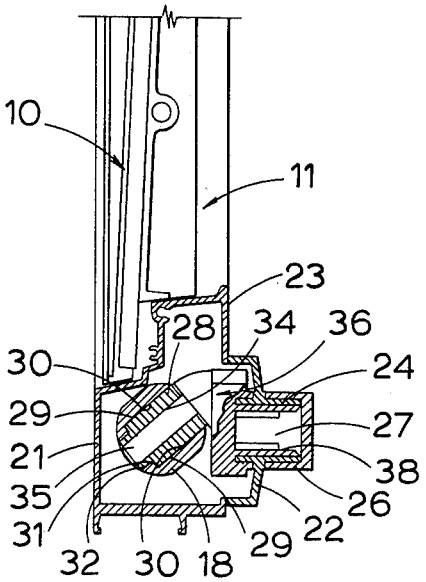
Figure 3:
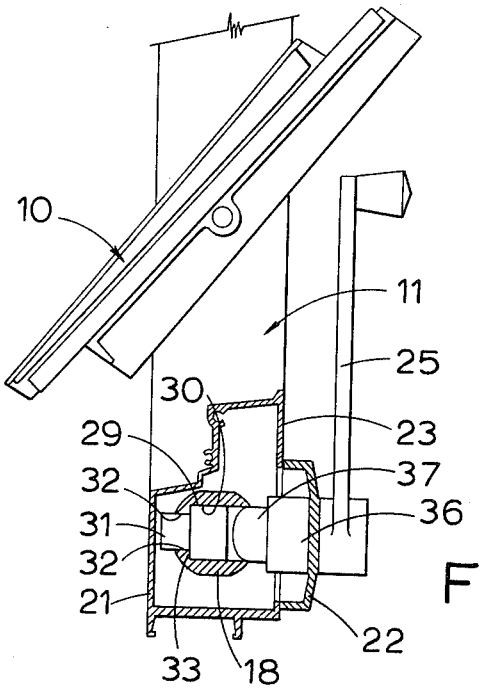
Figure 4:
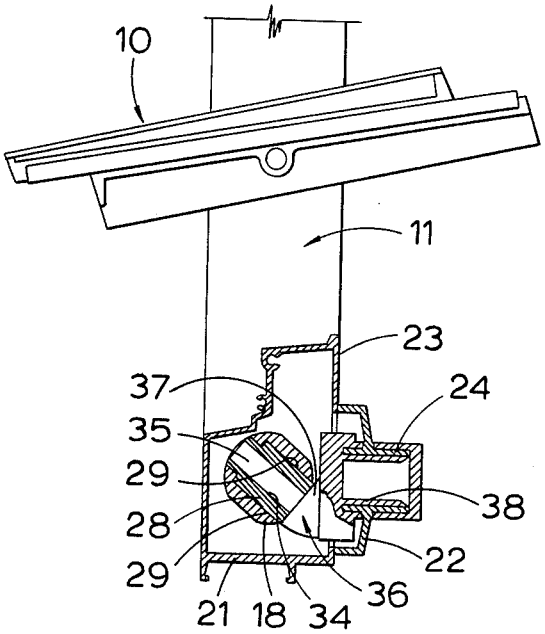
Figure 5:
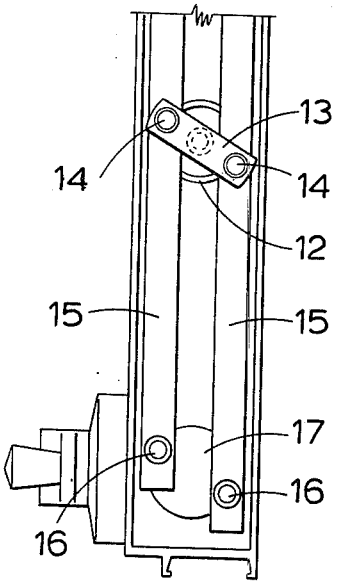

The invention will now be described by way of example with reference to one embodiment thereof which is illustrated in the accompanying drawings. In the drawings:

FIG. 1 is a plan view of the operating mechanism of a louvre window, with the window closed, FIG. 2 is a sectional view along the line 2—2 of FIG. 1, FIG. 3 is a sectional view of the operating mechanism with the window partially open, FIG. 4 is a similar sectional view with the window fully open, and FIG. 5 is a view in the direction indicated by the arrow A in FIG. 1.

The drawings illustrate an operating mechanism for a louvre window which comprises a plurality of panes of glass each arranged for pivotal movement about a horizontal axis. Each pane of glass is supported in a pair of end fittings 10 which are connected to the respective side members 11 of the window frame. For convenience, only the lowermost end fitting has been illustrated but each end fitting is constructed as described in British patent specification No. 1,042,731 to which reference should be made. Each end fitting 10 includes a drive plate 12 disposed in engagement with the outer face of the associated side member of the window frame. The drive plate 12 is connected to a drive-transmitting link 13 which is pivotally connected by studs 14 to a pair of vertical linkage rods 15. The lower ends of the linkage rods 15 at one side of the window are connected to studs 16 on a drive plate 17 connected to a horizontal torque tube 18 which extends between and is rotatably supported by the side frame members 11. As shown, each side frame member 11 includes an inner jamb section 19 and a surround section 20, the two sections being interlocked together and the linkage rods 15 and appendages being contained within the space between the two sections 19 and 20.

The torque tube 18 (which is formed as an aluminium extrusion) is wholly contained within a sill 21 constituting the lower member of the frame, the sill 21 being provided midway between the ends thereof with a cover plate 22 which fits over an opening formed in that wall 23 of the sill which, in use, faces inwardly of the room in which the window is fitted. The cover plate 22 includes a cylindrical portion 24 which is disposed with its axis horizontal and extending at right angles to the axis of the torque tube 18. The cylindrical portion 24 of the cover plate 22 acts as a bearing for a handle 25 including an arm terminating in a knob. The inner end of the arm is provided with an outer sleeve 26 which fits over the bearing portion 24 and with an externally splined spigot portion 27 which is received within the bearing portion 24.

As can be seen from the drawings, the hollow torque tube 18 has a block 28 fitted in the bore thereof, the block 28 having a pair of opposed parallel drive-transmitting surfaces 29 which have free sliding engagement with cooperative surfaces 30 of the tube. The block 28 is of uniform width (as measured between said surfaces 29) apart from an end portion 31 thereof which fits between cooperating surfaces 32 of the tube 18. A shoulder 33 is thus provided on the block 28 which engages locating and supporting surfaces of the tube. The block 28 is formed with a throughbore 34 in which a stainless steel pin 35 is received, the pin 35 being freely rotatable within the bore 34. In order to facilitate free relative movement between the pin 35, the block 28 and the tube 1, the block is desirably moulded from an acetal resin which is impregnated with oil to provide self-lubricating characteristics.

Pin 35 forms a part of a drive member 36 which is moulded from an acetal resin with the pin embedded in the moulding. The drive member 36 incorporates a crank 37 which interconnects the pin 35 and a generally cylindrical portion 38 which fits within the bearing portion 24 of the cover plate 22 and has splined engagement with the spigot portion 27 of the operating handle 25.

When the arm of the handle 25 is horizontal as shown in FIGS. 1 and 2 and the window is closed, the axis of the pin 35 is inclined at approximately 40° to the horizontal. Turning of the arm through 90° in the anticlockwise direction into the position shown in FIG. 3 results in the block 28 being displaced in the direction of the axis of the tube 18 and the pin 35 turning to a horizontal position. Further rotational movement of the handle 25 into the position shown in FIG. 4, in which the arm is again horizontal but turned through 180° relative to the position shown in FIGS. 1 and 2, results in the window being fully opened. During return movement of the arm to the position shown in FIGS. 1 and 2, the end fitting 10 reaches the closed position when the arm is at an angle of approximately 2° to the horizontal and the last increment of angular movement of the arm serves to load the tube 18 so that the linkage system positively biasses the louvre panels into the closed positions. The positive biassing of the panels into their closed positions results in the window being leakage-free even under conditions of strong wind and heavy rain.

The biassing action exerted on the panels is sufficient to lock the window in its closed position so that the window cannot be opened from outside. A separate locking mechanism is thus not required.

During opening of the window, the force applied to the arm will initially be a substantially vertical force and the moment exerted about the axis of the handle 25 will consist of the product of this force and the length of the arm. The moment obtained during opening movement, and again during closing movement, will be greatest when the arm is horizontal and, since this is the time at which binding forces will be greatest, overcoming of these binding forces and free movement of the handle is thereby facilitated. In the particular arrangement shown in the drawings the block 28 is provided with a shoulder 33 which engages locating and supporting surfaces of the tube 18. However, the block 28 may be of uniform width throughout and means provided for holding the pin 35 in engagement with the block 28.

What we claim is:

1. Operating means for a window including a horizontally pivoted panel, comprising an elongated, hollow torque tube arranged for rotation relative to the window frame about its axis of elongation, which axis is horizontal and extends from side to side of the window, a block fitted in a slot in the torque tube for rotation therewith, said block being movable axially of the torque tube within said slot, a pin freely rotatable within a bore formed in the block, said pin being rotatable relative to the torque tube about an axis extending transversely to the axis of the torque tube, an operating crank arranged for rotation relative to the window frame about a horizontal axis extending at right angles to the plane of the window, said pin being disposed at an acute angle at the last mentioned axis, and a drive connection between the pin and the crank.

2. Operating means according to claim 1, wherein the bore in the block extends at right angles to the axis of the torque tube.

3. Operating means according to claim 1, wherein the crank is formed either as a moulding from a synthetic plastics material of as a die-casting and the pin is integral therewith.

4. Operating means according to claim 3, wherein the crank includes a generally cylindrical portion which is mounted in a bearing aperture in a cover plate of the window frame and a connecting portion between the generally cylindrical portion and the part supporting the pin.

5. Operating means according to claim 4, wherein the generally cylindrical portion of the crank is internally splined for engagement with splined teeth of a handle.

6. Operating means for a window having a horizontally pivoted panel, comprising an elongated shaft extending from side to side of the window and arranged for rotation relative to the window frame about its axis of elongation, an operating member arranged for rotation relative to the window frame about an axis transverse to and intersecting said axis of elongation, and connector means whereby rotation of the operating member is effective to rotate the shaft, said connector means including a cranked drive member having a drive pin the axis of which also intersects said axis of elongation, said pin engaging with a bore, of a member arranged for rotation with the shaft and being movable axially relative to the shaft, said pin being disposed at an acute angle to said transverse axis.

7. Operating means according to claim 6, wherein the axis about which the operating member rotates is horizontal and the axis of the pin is inclined at about 40° to said horizontal axis.

8. Operating means according to claim 6, wherein the member which rotates with the shaft is a block provided with a shoulder which engages cooperative guide surfaces provided internally of the shaft to guide the block during sliding movement thereof in the direction of the axis of the shaft.

9. Operating means according to claim 6, wherein the cranked drive member is formed as a plastics moulding in which the drive pin is embedded, the plastics moulding including a generally cylindrical portion which is rotatably mounted in a bearing portion of the window frame and has a splined connection with the operating member.

10. Operating means according to claim 6, wherein the operating member includes an arm which is rotatable through 180° between a first horizontal position in which the panel is closed and a second horizontal position in which the panel is fully open.

* * * * *